US011795847B2

(12) United States Patent
Mettenleiter et al.

(10) Patent No.: US 11,795,847 B2
(45) Date of Patent: Oct. 24, 2023

(54) EXHAUST MUFFLER

(71) Applicant: Purem GmbH, Neunkirchen (DE)

(72) Inventors: Nicolas Mettenleiter, Köngen (DE); Andreas Wagner, Esslingen (DE); Max Borger, Leipzig (DE); Thomas Wolf, Esslingen (DE); Frank Sühnel, Wernau (DE)

(73) Assignee: PUREM GMBH, Neunkirchen (DE)

( * ) Notice: Subject to any disclaimer, the term of this patent is extended or adjusted under 35 U.S.C. 154(b) by 148 days.

(21) Appl. No.: 16/953,482

(22) Filed: Nov. 20, 2020

(65) Prior Publication Data

US 2021/0156287 A1 May 27, 2021

(30) Foreign Application Priority Data

Nov. 27, 2019 (DE) ..... 10 2019 132 097.6

(51) Int. Cl.

| | |
|---|---|
| ***F01N 1/02*** | (2006.01) |
| ***F01N 1/24*** | (2006.01) |
| ***F01N 13/18*** | (2010.01) |
| ***G10K 11/16*** | (2006.01) |

(52) U.S. Cl.

CPC ..... *F01N 1/023* (2013.01); *F01N 13/1894* (2013.01); *G10K 11/161* (2013.01); *F01N 2470/02* (2013.01); *F01N 2490/08* (2013.01); *F01N 2490/14* (2013.01)

(58) Field of Classification Search

CPC ..... F01N 13/18; F01N 13/00; F01N 13/141; F01N 13/14; F01N 13/143; F01N 13/1894; F01N 1/02; F01N 1/00; F01N 1/24; F01N 1/023; F01N 2510/08; F01N 2470/02; F01N 2490/08; F01N 2490/14; G10K 11/161

See application file for complete search history.

(56) References Cited

U.S. PATENT DOCUMENTS

| | | | | |
|---|---|---|---|---|
| 2,950,777 | A * | 8/1960 | Deremer | F01N 13/185 181/266 |
| 3,709,321 | A | 1/1973 | Malkiewicz | |
| 5,168,132 | A * | 12/1992 | Beidl | F01N 1/084 181/266 |
| 5,220,137 | A * | 6/1993 | Howerton | F01N 1/089 181/283 |
| 5,293,743 | A * | 3/1994 | Usleman | F01N 13/14 60/299 |
| 6,555,070 | B1 * | 4/2003 | Kruger | F01N 3/2853 422/177 |
| 7,004,283 | B2 * | 2/2006 | Worner | F01N 1/06 181/269 |

(Continued)

FOREIGN PATENT DOCUMENTS

| | | |
|---|---|---|
| CN | 1908395 A | 2/2007 |
| CN | 104514605 A | 4/2015 |

(Continued)

*Primary Examiner* — Edgardo San Martin

(74) *Attorney, Agent, or Firm* — McGlew and Tuttle, P.C.

(57) ABSTRACT

An exhaust muffler for an exhaust system of an internal combustion engine includes a muffler housing (12) with an outer shell (14) enclosing a muffler interior (22), through which exhaust gas can flow. An inner shell (54) is arranged in the muffler interior (22) and covers the outer shell (14) in at least some areas on an inner side (52) facing the muffler interior (22).

23 Claims, 2 Drawing Sheets

(56) References Cited

U.S. PATENT DOCUMENTS

| | | | | |
|---|---|---|---|---|
| 7,273,129 | B2 * | 9/2007 | Harwood | F01N 13/14 181/282 |
| 7,281,606 | B2 * | 10/2007 | Marocco | F01N 3/2892 181/275 |
| 7,287,622 | B2 * | 10/2007 | Rauch | F01N 13/0097 181/269 |
| 7,694,778 | B2 * | 4/2010 | Toyoshima | F01N 1/10 181/252 |
| 8,505,682 | B2 * | 8/2013 | Jones | F01N 1/084 181/246 |
| 8,770,342 | B2 * | 7/2014 | Wirth | F01N 1/10 181/282 |
| 9,810,117 | B2 * | 11/2017 | Hiraoka | F01N 13/082 |
| 10,787,943 | B2 * | 9/2020 | Kishikawa | F01N 1/166 |
| 11,319,847 | B2 * | 5/2022 | Zuver | F01N 1/023 |
| 2002/0050419 | A1 | 5/2002 | Dooley | |
| 2004/0178016 | A1 | 9/2004 | Yamamoto et al. | |
| 2015/0068835 | A1 | 3/2015 | Dedene | |

FOREIGN PATENT DOCUMENTS

| | | | | |
|---|---|---|---|---|
| CN | 105386843 | A | 3/2016 | |
| DE | 1268434 | B | 5/1968 | |
| DE | 102014217058 | A1 | 3/2016 | |
| EP | 0523008 | A1 | 1/1993 | |
| FR | 2488329 | A1 * | 2/1982 | F01N 13/14 |

* cited by examiner

EXHAUST MUFFLER

CROSS REFERENCE TO RELATED APPLICATIONS

This application claims the benefit of priority under 35 U.S.C. § 119 of German Application 10 2019 132 097.6, filed Nov. 27, 2019, the entire contents of which are incorporated herein by reference.

TECHNICAL FIELD

The present invention pertains to an exhaust muffler, which can be used, for example, in the exhaust system of an internal combustion engine in a motor vehicle.

TECHNICAL BACKGROUND

Hot combustion exhaust gases emitted by an internal combustion engine flow through the mufflers used in exhaust systems of internal combustion engines. These combustion exhaust gases may have a temperature in the range of several 100° C. and thus lead to a comparatively strong thermal load of the system areas of an exhaust system, through which system areas these combustion exhaust gases flow. This may lead to a tarnishing, i.e., to a thermally induced discoloration, which is especially undesired if the system areas of an exhaust system, such as exhaust mufflers used as end mufflers in particular, are installed in a vehicle in a visible manner.

SUMMARY

An object of the present invention is to provide an exhaust muffler for an exhaust system of an internal combustion engine, in which the risk of a discoloration, which is induced by thermal load and is visible from the outside, does not exist.

This object is accomplished according to the present invention by an exhaust muffler for an exhaust system of an internal combustion engine, comprising a muffler housing with an outer shell enclosing a muffler interior, through which exhaust gas can flow, and with an inner shell, which is arranged in the muffler interior and covers the outer shell in at least some areas on an inner side facing the muffler interior.

By covering the outer shell with an inner shell, the direct thermal interaction of the hot combustion exhaust gases introduced into the muffler interior with the outer shell, which leads to a tarnishing, is avoided. The hot combustion exhaust gases introduced into the muffler interior at first come into contact with the inner shell and lead to a relatively strong thermal load of the inner shell. However, a contact of the exhaust gases also with the outer shell, which contact basically cannot be avoided, cannot cause tarnishing of the outer shell, since the exhaust gases are cooled off during contact with the inner shell, and thus the exhaust gases coming into contact with the outer shell have a markedly lowered temperature.

The outer shell may comprise an outer circumferential wall which is elongated in the direction of a muffler longitudinal axis and encloses same and an end wall connected to the outer circumferential wall at both axial end areas of this outer circumferential wall, and the inner shell may comprise at least one inner shell part covering the outer circumferential wall on its inner side in at least some areas at least in association with the outer circumferential wall.

A stable configuration of the muffler housing enclosing the muffler interior in a defined manner, in which a thermally induced discoloration of the outer shell can be ruled out, can be made possible, as an alternative, by the outer shell comprising two outer shell parts that are connected to one another in a connection edge area, and by the inner shell comprising an inner shell part covering the outer shell part on its inner side in at least some areas in association with at least one outer shell part, and preferably with each outer shell part.

In order to be able to generate for the outer shell a protection provided by the shielding effect of the inner shell against a thermally induced discoloration even more efficiently, an intermediate space can be formed between the outer shell and the inner shell, wherein the inner shell is supported directly at the outer shell in at least one support area. Due to the provision of at least one such support area, in which there is a direct physical contact between the outer shell and the inner shell, a defined positioning of the inner shell in the muffler interior, which also avoids the development of clapping noises due to a striking of the inner shell against the outer shell, is nevertheless guaranteed.

For an efficient shielding action with minimal compromise of the volume of the muffler interior, it is proposed that a distance between the outer shell and the inner shell be in the range of 3 mm to 7 mm, preferably about 5 mm in the area of the intermediate space.

To achieve the muffling characteristic to be provided by the exhaust muffler, at least one partition dividing the muffler interior into a plurality of chambers may be provided in the muffler interior. At least one partition may be supported in a circumferential edge area in relation to the outer shell with intermediate placement of the inner shell to be able to guarantee a defined positioning for such a partition in the muffler interior as well.

For this purpose, provisions may especially be made for the partition to be supported in relation to the outer shell in the area of a support area. The result is that the partition is supported in a stable manner where the inner shell is also in direct contact with the outer shell. Furthermore, a defined holding of the inner shell without inclusion of a connection in substance with the outer shell may be achieved by the inner shell being held at the outer shell by the partition.

A further improved supporting action for the inner shell can be achieved by a plurality of partitions arranged following one another in the direction of a muffler longitudinal axis being provided in the muffler interior, and by the inner shell being supported in relation to the outer shell in a respective support area in the area of a plurality of partitions, preferably all partitions.

If a plurality of partitions are provided in an exhaust muffler, the outer shell may be covered on its inner side by the inner shell essentially only in a partition length area in the direction of the muffler longitudinal axis, wherein the partition length area is a length area of the outer shell, which length area extends from a first end partition positioned closest to a first muffler longitudinal end to a second end partition positioned closest to a second muffler longitudinal end. Such an embodiment then suggests itself because of a low construction weight, the exhaust gases emitted by an internal combustion engine are introduced into one or more of the chambers formed between the partitions and, above all, an efficient shielding for the outer shell shall be provided in this area.

In an alternative type of embodiment, the outer shell may be covered by the inner shell essentially on its entire inner side. This suggests itself, above all, if there is a risk that a discoloration of the outer shell is caused by thermal load in the entire length area of the outer shell.

Also, in order to be able to prevent a striking, caused by vibrations, of the inner shell against the outer shell in areas, in which a direct support of the inner shell in relation to the outer shell shall not be achieved, it is proposed that the inner shell be held at a distance in relation to the outer shell via a holding material in at least one holding area, preferably in a plurality of holding areas.

The holding material may comprise, for example, wire material, for example, wire mesh, knitted wire, wire fabric or wire nonwoven.

Depending on the structural configuration of an exhaust system, it may be necessary to guide pipes comparatively close to the outer shell, which pipes are inserted into the outer shell or extend in the muffler interior. In order to thereby avoid a conflict with the inner shell, at least one recess, for example, embodied as at least slot or at least one opening may be provided in the inner shell. A pipe arranged in the interior of the outer shell may be positioned such that it meshes with such one or more recess, or it is possible to lead exhaust gas, which flows into the muffler interior or flows out of same, through such recesses.

A configuration, which can be embodied in a simple and cost-effective manner and is resistant to exhaust gases and the thermal load generated by these exhaust gases, can be achieved, for example, by the inner shell being made of sheet metal material.

The present invention pertains, moreover, to an exhaust system for an internal combustion engine, comprising at least one exhaust muffler in accordance with the invention.

The present invention will be described in detail below with reference to the attached FIGURE. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
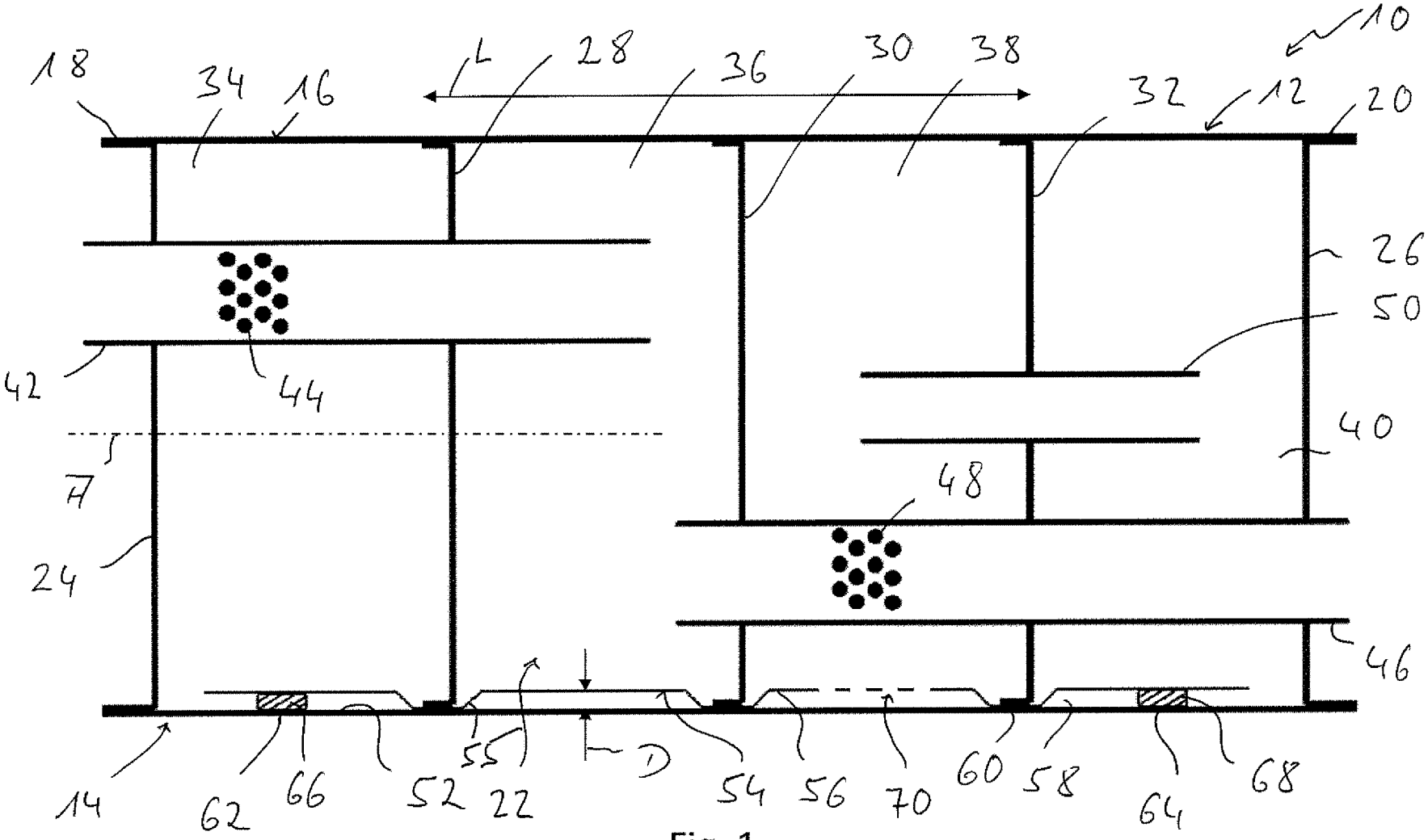
FIG. 1 is a schematic diagram of a longitudinal section of an exhaust muffler.

Referring to the drawings, the exhaust muffler 10 shown in the longitudinal section in FIG. 1 has a muffler housing 12 with an outer shell, which is generally designated by 14. In the exemplary embodiment shown, the outer shell 14 comprises an outer circumferential wall 16 which is elongated in the direction of a muffler longitudinal axis A and encloses same. This outer circumferential wall 16 may be provided, for example, by an essentially cylindrical component, but may, as an alternative, be provided, for example, by two half shells as well. The outer circumferential wall 16 is permanently connected at both axial end areas 18, 20, for example, by welding or/and flanging each to an end wall 24, 26 axially closing a muffler interior 22.

A plurality of partitions following one another in the direction of the muffler longitudinal axis A are provided in the interior of the muffler housing 12. In this case, the partitions arranged closest to the end walls 24, 26 form respective end partitions each.

A plurality of chambers 34, 36, 38, 40, which follow one another axially, are formed in the muffler interior 22 between the end walls 24, 26 and the partitions 28, 30, 32. An inlet pipe 42 traverses the end wall 24 and the partition or end partition 28 and extends through the chamber 34 up to the chamber 36 and is open towards this chamber. In the area of the chamber 34, the inlet pipe 42 may be open towards the chamber 34 via a plurality of openings 44. An outlet pipe 46 traverses the end wall 26 and the partitions 32, 30 and extends into the chamber 36 and is open towards this chamber. The outlet pipe 46 is open towards the chamber 38 via a plurality of openings 48 in the area of the chamber 38. The chamber 38 and the chamber 40 are connected to one another via a pipe 50, which is active as a resonator pipe and thus provides a resonator neck, so that the chamber 40 can be active as a Helmholtz resonator in connection with the pipe 50.

It should be pointed out that the above-described basic configuration of the exhaust muffler 10 with its muffler housing 12 is shown only as an example. More or fewer partitions than those shown in FIG. 1 could be provided. Also, more or fewer inlet pipes or/and outlet pipes could be provided, and the chambers formed in the muffler interior could communicate with one another in a different way. It should also be pointed out that the muffler housing 12 in an alternative embodiment could be configured with two half shells, each of which may provide a part of the outer circumferential wall and a part of the two end walls. Such half shells to be called, for example, outer shell parts can be permanently connected to one another by connection in substance, for example, welding or/and by flanging, in a connection edge area. Just as the outer circumferential wall 16, the end walls 24, 26 and the partitions 28, 30, 32 in the configuration shown, such half shells of a muffler housing can also be provided as shaped sheet metal parts and may have corresponding openings for passing through one or more inlet pipes or one or more outlet pipes in the area of the outer circumferential wall provided by these half shells or also in the area of the end walls provided by these half shells.

The exhaust muffler 10 comprises, in addition to the outer shell 14, an inner shell 54 covering an inner side 52 of the outer shell 14 or of the outer circumferential wall 16 in at least some areas. The inner shell 54 is preferably configured with one or more inner shell parts provided as shaped sheet metal parts, which may be arranged following one another, for example, in the circumferential direction about the muffler longitudinal axis A or may be provided each in association with one of the two outer shell parts in case of the configuration of the outer shell with two outer shell parts and can be arranged covering this outer shell part on its inner side in at least some areas.

An intermediate space 58 is formed between the inner shell 54 and the outer shell 14 or the outer circumferential wall 16 in the exemplary embodiment shown. To provide this intermediate space, the distance D existing between the outer shell 14 and the inner shell 54 may be in the range of 3 mm to 7 mm, preferably about 5 mm. In a plurality of support areas 60 following one another in the direction of the muffler longitudinal axis A, the inner shell 54 is shaped with radial bulges 55 extending in the circumferential direction such that it is in contact with the inner side 52 of the outer shell 14, for example, in its entire extension area in the circumferential direction about the muffler longitudinal axis A and is thus supported directly at the outer shell 14. These support areas 60 that are provided by the radial bulges 55 may be positioned such that they are located where the partitions 28, 30, 32 are also arranged, so that these partitions 28, 30, 32 are supported in relation to the outer shell 14 at least in a circumferential area corresponding to the area of extension of the inner shell 54 with intermediate placement of the inner shell 54. The inner shell 54 is held at the outer shell 14 in the area of the support areas by means of the radial clamping action provided by means of the partitions 28, 30, 32. An additional connection in substance of the inner shell 54 to the outer shell 14 is not necessary and is not intended. A connection in substance of the partitions 28, 30, 32 to the inner shell 54 and to the outer shell 14 is not necessary or intended. The partitions 28, 30, 32 are held axially in relation to the inner shell 54 due to their meshing with the radial bulges 55 of the inner shell 54. In the area of the radial bulges 55 of the inner shell 54, the outer shell 14 or the outer circumferential wall 16 may also have corresponding radial bulges, which extend in the circumferential direction and with which the radial bulges 55 of the inner shell 54 can partially mesh radially and with which, for example, in circumferential areas, in which the outer shell 14 is not covered by the inner shell 54, the partitions 28, 30, 32 with their radially outer area can be positioned such that they mesh, so that a defined radial and axial holding of the partitions 28, 30, 32 in relation to the muffler housing 12 is also guaranteed in these circumferential areas.

In the exemplary embodiment shown, the inner shell 54 extends almost over the entire axial area of extension of the outer shell 14 or of the muffler interior 22 up to close to the end walls 24, 26. In order to ensure a defined positioning of the inner shell 54 in relation to the outer shell 14 in the end areas of the inner shell 54, which end areas are not supported via a support area in relation to the outer shell 14 or are not fixed thereto, the inner shell 54 is supported in relation to the outer shell 14 in a plurality of holding areas 62, 64 via holding material 66, 68 provided there in each case. This holding material may comprise, for example, wire material, e.g., a wire mesh or a wire nonwoven or the like, which is held distributed in the circumferential direction at a plurality of areas between the outer shell 14 and the inner shell 54.

FIG. 1 shows, indicated by breaks in the line, one or more recesses 70, embodied as one more slots or one or more openings 70, in the inner shell 54 or in the inner shell part 56 shown in FIG. 1 in an area between the partitions 30 and 32. For example, a pipe extending in the muffler interior 22 close to the outer shell 14 may mesh with such recesses 70 in order to prevent such a pipe from being led too close to the inner shell 54 and thus prevent noises from developing due to contact with each other during the operation.

In an alternative embodiment suggested in FIG. 1, the inner shell 54 may also be provided limited to a partition length area L, which extends essentially over the length area of the muffler housing 12, which length area L extends between the two partitions or end partitions 28, 32.

In another alternative embodiment, the inner shell 54 may also be shaped in the configuration of the muffler housing 12 shown in FIG. 1 such that it at least partially covers at least one of the end walls 24, 26 and thus shields against the direct incoming flow of exhaust gas on the inner side thereof. For this purpose, the inner shell 54 may be shaped in the radially inwards direction at a longitudinal end located close to a corresponding end wall 24 or 26.

Due to the provision of the inner shell 54, the thermal shielding of the outer shell 14 is especially achieved in areas of the muffler housing 12 that are thermally highly exposed to the exhaust gas introduced into the muffler interior 22. Due to this thermal shielding of the outer shell 14, a tarnishing, i.e., a thermally induced discoloring of the outer shell, is avoided. This is especially advantageous where an exhaust muffler 10 is not hidden in the interior of a vehicle, is placed, for example, under the underbody of a vehicle, but is visible from outside as an essential component of the optical appearance of a vehicle. Since the inner shell preventing the occurrence of tarnishing is pressed firmly against the outer shell 14 especially without generating a connection in substance due to the partitions 28, 30, 32 or at least some of the partitions 28, 30, 32, there is no compromise of the structural strength of the exhaust muffler.

Figure 2:
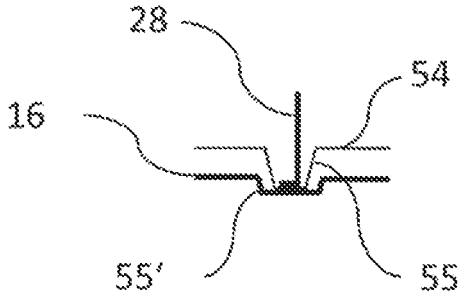
FIG. 2 is a view showing an engaging interaction of a partition with bulges of an inner shell and an outer shell.

FIG. 2 is a view showing an engaging interaction of the partition 28 with the bulge 55 of the inner shell 54 and a bulge 55' of the outer circumferential wall 16 of the outer shell 14.

While specific embodiments of the invention have been shown and described in detail to illustrate the application of the principles of the invention, it will be understood that the invention may be embodied otherwise without departing from such principles.

What is claimed is:

1. An exhaust muffler for an exhaust system of an internal combustion engine, the exhaust muffler comprising a muffler housing, the muffler housing comprising:

an outer shell enclosing a muffler interior through which exhaust gas can flow; and an inner shell arranged in the muffler interior and covering the outer shell in at least some areas on an inner side facing the muffler interior, wherein:

an intermediate space is formed between the outer shell and the inner shell;

the inner shell is supported directly at the outer shell in at least one support area; and the inner shell is held at a distance in relation to the outer shell via a holding material in holding areas in end areas of the inner shell not supported at the outer shell via support areas.

2. The exhaust muffler in accordance with claim 1, wherein:

the outer shell comprises an outer circumferential wall, which is elongated in a direction of a muffler longitudinal axis and encloses same and an end wall connected to each of two axial end areas of the outer circumferential wall; and the inner shell comprises at least one inner shell part covering the outer circumferential wall on the inner side facing the muffler interior in at least some areas at least in association with the outer circumferential wall.

3. The exhaust muffler in accordance with claim 1, wherein:

the outer shell comprises two outer shell parts connected to one another in a connection edge area; and the inner shell comprises an inner shell part covering the outer shell part on the inner side facing the muffler interior in at least some areas in association with at least one of the outer shell parts.

4. The exhaust muffler in accordance with claim 1, wherein a distance between the outer shell and the inner shell is in the range of 3 mm to 7 mm in the area of the intermediate space.

5. The exhaust muffler in accordance with claim 1, further comprising at least one partition in the muffler interior, the at least one partition dividing the muffler interior into a plurality of chambers, wherein the at least one partition is supported in relation to the outer shell in a circumferential edge area with an intermediate placement of the inner shell.

6. The exhaust muffler in accordance with claim 5, wherein:

at least one partition of the at least one partition is supported in relation to the outer shell in the area of a respective support area, or the inner shell is held at the outer shell by at least one partition of the at least one partition or at least one partition of the at least one partition is supported in relation to the outer shell in the area of a respective support area and the inner shell is held at the outer shell by the least one partition of the at least one partition.

7. The exhaust muffler in accordance with claim 5, wherein:

a plurality of partitions are arranged following one another in a direction of a muffler longitudinal axis in the muffler interior; and the inner shell is supported in relation to the outer shell in a respective support area in an area of at least some of the plurality of partitions.

8. The exhaust muffler in accordance with claim 1, wherein the outer shell is covered by the inner shell essentially on an entire inner side.

9. The exhaust muffler in accordance with claim 1, wherein the holding material comprises wire material.

10. The exhaust muffler in accordance with claim 1, wherein at least one recess is provided in the inner shell.

11. The exhaust muffler in accordance with claim 1, wherein the inner shell is made of sheet metal material.

12. An exhaust system for an internal combustion engine, comprising an exhaust muffler, the exhaust muffler comprising a muffler housing, the muffler housing comprising:

an outer shell enclosing a muffler interior through which exhaust gas can flow; and an inner shell arranged in the muffler interior and covering the outer shell in at least some areas on an inner side facing the muffler interior, wherein:

an intermediate space is formed between the outer shell and the inner shell;

the inner shell is supported directly at the outer shell in at least one support area; and the inner shell is held at a distance in relation to the outer shell via a holding material in holding areas in end areas of the inner shell not supported at the outer shell via support areas.

13. The exhaust system in accordance with claim 12, wherein:

the outer shell comprises an outer circumferential wall, which is elongated in a direction of a muffler longitudinal axis and encloses same and an end wall connected to each of two axial end areas of the outer circumferential wall; and the inner shell comprises at least one inner shell part covering the outer circumferential wall on the inner side facing the muffler interior in at least some areas at least in association with the outer circumferential wall.

14. The exhaust system in accordance with claim 12, wherein:

the outer shell comprises two outer shell parts connected to one another in a connection edge area; and the inner shell comprises an inner shell part covering the outer shell part on the inner side facing the muffler interior in at least some areas in association with at least one of the outer shell parts.

15. The exhaust system in accordance with claim 12, further comprising at least one partition in the muffler interior, the at least one partition dividing the muffler interior into a plurality of chambers, wherein the at least one partition is supported in relation to the outer shell in a circumferential edge area with an intermediate placement of the inner shell.

16. The exhaust system in accordance with claim 15, wherein at least one partition of the at least one partition is supported in relation to the outer shell in the area of a respective support area, or the inner shell is held at the outer shell by at least one partition of the at least one partition or at least one partition of the at least one partition is supported in relation to the outer shell in the area of a respective support area and the inner shell is held at the outer shell by the at least one partition of the at least one partition.

17. The exhaust system in accordance with claim 15, wherein:

a plurality of partitions are arranged following one another in a direction of a muffler longitudinal axis in the muffler interior; and the inner shell is supported in relation to the outer shell in a respective support area in an area of at least some of the plurality of partitions.

18. The exhaust muffler in accordance with claim 2, wherein each one of the end areas of the inner shell is axially spaced from an adjacent one of the end walls.

19. The exhaust muffler in accordance with claim 2, wherein each one of the end walls is fixed to one of two axial ends of the outer circumferential wall by at least one of welding and flanging.

20. The exhaust muffler in accordance with claim 5, wherein at least one partition of the at least one partition is supported in relation to the outer shell in the area of a respective support area and the inner shell is held at the outer shell by a radial clamping action provided by the at least one partition of the at least one partition engaging a radial bulge of the inner shell meshing with a radial bulge of the outer shell.

21. The exhaust system in accordance with claim 13, wherein each one of the end areas of the inner shell is axially spaced from an adjacent one of the end walls.

22. The exhaust system in accordance with claim 13, wherein each one of the end walls is fixed to one of two axial ends of the outer circumferential wall by at least one of welding and flanging.

23. The exhaust muffler in accordance with claim 15, wherein at least one partition of the at least one partition is supported in relation to the outer shell in the area of a respective support area and the inner shell is held at the outer shell by a radial clamping action provided by the at least one partition of the at least one partition engaging a radial bulge of the inner shell meshing with a radial bulge of the outer shell.

* * * * *